US005258816A

United States Patent [19]

Haneda et al.

[11] Patent Number: 5,258,816

[45] Date of Patent: Nov. 2, 1993

[54] CLEANING DEVICE FOR A COLOR IMAGE FORMING APPARATUS

[75] Inventors: Satoshi Haneda; Masakazu Fukuchi, both of Hachioji; Shizuo Morita, Tachikawa; Shunji Matsuo, Hino, all of Japan

[73] Assignee: Konica Corporation, Tokyo, Japan

[21] Appl. No.: 839,283

[22] Filed: Feb. 25, 1992

Related U.S. Application Data

[63] Continuation of Ser. No. 644,439, Jan. 22, 1991, abandoned.

[30] Foreign Application Priority Data

Jan. 26, 1990 [JP] Japan ..... 2-6954
Jan. 26, 1990 [JP] Japan ..... 2-17229

[51] Int. Cl.[5] ..... G03G 21/00; G03G 15/01

[52] U.S. Cl. ..... 355/296; 198/814; 355/210; 355/212; 355/299; 355/326 R

[58] Field of Search ..... 355/326, 327, 210, 296, 355/299, 212; 198/814, 841; 474/117, 138, 115

[56] References Cited

U.S. PATENT DOCUMENTS

| | | | |
|---|---|---|---|
| 4,145,137 | 3/1979 | Sunaga et al. | 355/299 |
| 4,174,171 | 11/1979 | Hamaker et al. | 355/212 |
| 4,279,496 | 7/1981 | Silverberg | 355/212 |
| 4,357,098 | 11/1982 | Endo | 355/299 |
| 4,432,632 | 2/1984 | Yokota | 355/212 X |
| 4,500,195 | 2/1985 | Hosono | 355/208 |
| 4,634,264 | 1/1987 | Takahashi | 355/200 |
| 4,640,608 | 2/1987 | Higaya et al. | 355/299 |
| 4,657,370 | 4/1987 | Forbes, II et al. | 355/212 |
| 4,702,591 | 10/1987 | Tsuda et al. | 355/299 |
| 4,786,937 | 11/1988 | Bouwens | 355/297 |
| 4,804,993 | 2/1989 | Kenin et al. | 355/212 |
| 4,849,795 | 7/1989 | Spehrley, Jr. et al. | 355/327 X |
| 4,893,740 | 1/1990 | Hediger et al. | 226/23 |
| 4,901,110 | 2/1990 | Tompkins et al. | 355/212 |
| 4,908,668 | 3/1990 | Takamatsu et al. | 355/274 |
| 4,924,272 | 5/1990 | Hediger et al. | 355/212 X |
| 4,994,853 | 2/1991 | Fukuchi et al. | 355/327 X |
| 5,036,367 | 7/1991 | Haneda et al. | 355/326 |
| 5,047,801 | 9/1991 | Haneda et al. | 355/327 X |
| 5,063,411 | 11/1991 | Haneda et al. | 355/212 |
| 5,065,195 | 11/1991 | Haneda et al. | 355/212 X |
| 5,073,800 | 12/1991 | Yamaguchi et al. | 355/299 X |

FOREIGN PATENT DOCUMENTS

| | | | |
|---|---|---|---|
| 61-130972 | 6/1986 | Japan | 355/212 |

*Primary Examiner*—A. T. Grimley
*Assistant Examiner*—Nestor R. Ramirez
*Attorney, Agent, or Firm*—Finnegan, Henderson, Farabow, Garrett & Dunner

[57] ABSTRACT

A color printer that forms a developed toner image on a photoreceptor. The color printer includes a photoreceptor having a belt-like shape, a driver roller of the photoreceptor belt, a follower roller to which the photoreceptor belt is suspended to keep a rotation position of the belt, a cleaner to clean off the residual toner on the photoreceptor after the developed toner image is transferred to a recording sheet, and a device to maintain a mechanical relation between the follower roller and the cleaner so that the cleaner cleans the photoreceptor belt in a constant condition. Above all devices of the driver roller, the follower roller, the cleaner, and the maintaining device are unitized in a cartridge to be detached from the main body of the color printer.

8 Claims, 10 Drawing Sheets

CLEANING DEVICE FOR A COLOR IMAGE FORMING APPARATUS

This application is a continuation of application Ser. No. 07/644,439, filed Jan. 22, 1991, now abandoned.

BACKGROUND OF THE INVENTION

The present invention relates to a color image forming apparatus wherein a toner image is formed on a belt-like image forming means through an electrophotographic system and then the toner image is transferred onto an image-transfer material to be an aimed image.

A number of methods and apparatuses have been proposed for obtaining a color image through an electrophotographic method. As is disclosed in Japanese Patent Publication Open to Public Inspection No. 100770/1986 (hereinafter referred to as Japanese Patent O.P.I. Publication), for example, a method exists wherein latent images corresponding to the number of separated colors of an original image are formed and developed on a photoreceptor drum that is an image retainer, and after each development for each color image, the color image is transferred onto an image-transfer drum to form a multi-color image thereon, said multi-color image being transferred onto a recording paper to be a color copy. An apparatus for this method requires not only a photoreceptor drum but also an image-transfer drum having a size capable of accepting thereon a whole image of an entire page, resulting in a large size and a complicated structure.

As is disclosed in Japanese Patent O.P.I. Publication No. 149972/1986, for example, a further method exists wherein latent images corresponding to the number of separated colors of an image on an original are formed and developed on a photoreceptor drum, and after each development for each color image, the color image is transferred onto an image-transfer material to form a multi-color image thereon. In this method, it is difficult to register or superpose, accurately in position, images each having different colors and thereby it is impossible to obtain a color copy of good quality.

A further method exists wherein formation of a latent image and its development with a color toner are repeated for the number of times corresponding to the number of separated colors of an image on an original, and after registering images each having different colors on a photoreceptor drum, they are transferred and thus a color image is obtained. The basic processes for forming multi-color images in aforesaid method are disclosed in Japanese Patent O.P.I. Publication Nos. 75850/1985, 76766/1985, 95456/1985, 95458/1985 and 158475/1985.

In such a multi-color image forming apparatus wherein a color image is obtained through registering of images, there are provided a plurality of developing units each having therein different color toners around a photoreceptor drum, and the photoreceptor drum is generally rotated repeatedly to develop latent images thereon. Thus, a color image is obtained.

With regard to an image forming means, there has also been proposed, in addition to a photoreceptor drum on the peripheral surface of which a photoconductive substance is coated or evaporated as stated above, a belt-like image forming means wherein a photoconductive substance is coated or provided on a flexible belt. Since the shape of the belt-like image forming means (hereinafter referred also as a photoreceptor belt) is determined when it is spread between rotating rollers including a driving roller, the photoreceptor belt is effective when making, by utilizing the space effectively, a color image forming apparatus that is compact in size. Further, since the photoreceptor belt is capable of running along a path whose radius of curvature is small, it is possible to prevent a failure of separation.

In the color image forming apparatus mentioned above, image forming means such as a charging means, an exposure means, a plurality of developing units and a cleaning means are provided detachably in the apparatus as an independent unitized process cartridge including aforesaid photoreceptor belt so that the image forming means are arranged below the lower side of aforesaid photoreceptor belt to face the lower surface of the belt.

However, when many image forming means are unitized in a cartridge, the cartridge tends to be large in size and heavy in weight, thus it is difficult to mount it on or dismount it from the main body of the apparatus, and it is inconvenient from the viewpoint of maintenance because each image forming means has its own life or maintenance frequency which differs from others. Further, it is generally necessary to provide a tension roller for the purpose of keeping the photoreceptor belt spread with tension.

The first object of the invention is to provide a color image forming apparatus wherein a photoreceptor belt that is spread with tension and a cleaning means are unitized for maintenance, and other image forming means can be mounted on or dismounted from the main body of an apparatus easily without any interference.

The invention also relates to an image forming apparatus wherein it is possible to select any of a color mode in which toner images of different colors are superposed on a rotating photoreceptor surface and a color toner image thus formed is transferred, and a single color mode in which a single color toner image is formed on a rotating photoreceptor surface and then is transferred from the photoreceptor surface. In this type of image forming apparatus, there have been known an apparatus employing a cleaning means whose blade is caused to be in contact, partially at its end portion, with the surface of a photoreceptor. Toner thus scraped off the surface onto the blade is caused to drop from the other end portion of the blade.

In the conventional image forming apparatus mentioned above, from the viewpoint of the life of a photoreceptor and that of a blade, the blade of a cleaning means is kept away from the surface of the photoreceptor in a non-operation position before the start of an image forming process in which the photoreceptor is stationary; and after the start of the image forming process in which the photoreceptor is rotating in any mode selected, one end portion of the blade of the cleaning means in many cases is caused to be in contact with the surface of the photoreceptor. When a single color mode is selected, the cleaning means is kept in its operation position during the period that a single color toner image forming and its transfer are repeated for the specified number of times and the photoreceptor makes one turn or more before it stops, thus the image forming process is completed. When a color mode is selected, the cleaning means is returned to its non-operation position before the leading edge of a component color toner image formed first on the photoreceptor surface through one turn or more of the photoreceptor reaches the cleaning means, and that position is maintained until the trailing edge of a component color toner image preceding the last image finishes passing the position of the cleaning means. Then, the cleaning means is caused to be in the operation position before the leading edge of the photoreceptor surface from which the color toner image has been transferred reaches the cleaning means, and that position is maintained until the photoreceptor makes at least one turn. After that, when the specified number for color toner forming is one, the image forming process is completed similarly to that of the single color mode, while, in the case of a plural specified number for color toner image forming, the photoreceptor continues rotating and the cleaning means is switched repeatedly as described above until the last color toner image forming and its transfer are completed, thus the image forming process is finished finally as in the case where the specified number is one.

In the image forming apparatus mentioned above, on the other hand, due to the various restrictions, the blade of the cleaning means sometimes can not be slanted fully to prevent toners from staying on the blade on condition that one end portion of the blade is in contact with the photoreceptor surface. This tends to happen when a belt-like photoreceptor whose lower side is in tension and upper side is loose is used as a photoreceptor, a plurality of developing units are provided below the belt-like photoreceptor, transfer is performed at the position of a driving roller for the belt-like photoreceptor, and cleaning is performed at the position of a driven roller, for the purpose of a compact image forming apparatus, less toner contamination, standardization of a plurality of developing units, same conditions for photoreceptors and the structure for the easy opening and access to the path of image-transfer paper.

Even when the blade of a cleaning means can not be slanted fully in its operation position in the image forming apparatus as stated above, the cleaning means is switched to its non-operation position for each color toner image formation and thereby the blade leaves the photoreceptor and inclines fully when a color mode is selected. Therefore, toner staying on the blade until that time drop, preventing a large amount of toner from staying on the blade. When a single color mode is selected, however, the cleaning means is not switched to its non-operation position during the period of single color toner image formations for the specified number of times. When the specified number is large, therefore, a large amount of toner stay on the blade, resulting in elastic deformation of the blade, deterioration of cleaning capability and occurrence of toner contamination.

The invention has been devised for solving the problems mentioned above and its second object is to provide an image forming apparatus wherein a large amount of toners do not stay on the blade and thereby stabilized cleaning can be performed even when the blade of the cleaning means can not be slanted fully in its operation condition and single color toner image formations are repeated for the large specified number of times under the condition of a single color mode.

SUMMARY OF THE INVENTION

The first object mentioned above is achieved by the first example of an image forming apparatus comprising a detachable process unit composed of a belt-like image retainer spread between a driving roller rotating stationarily and a tension roller and of a cleaning means both united together, wherein aforesaid tension roller and aforesaid cleaning means are positioned through a relative-position-keeping member. It is preferable, in this case, that aforesaid cleaning means is urged with pressure against a portion of the belt-like image retainer positioned on aforesaid tension roller.

Further, the aforesaid first object can be achieved also by the second example of a color image forming apparatus comprising a detachable process unit in which a belt-like image retainer spread between a driving roller rotating stationarily and a tension roller, a cleaning means and a casing for the former two items are united together, wherein the cleaning means fixed on aforesaid casing is urged with pressure against aforesaid portion of the belt-like image retainer positioned on aforesaid tension roller. It is preferable, in this case, that aforesaid casing is provided with a regulating means that regulates the position of an axis of aforesaid tension roller.

The second object of the invention is achieved by the third example of an image forming apparatus having therein a color mode in which a color toner image composed of superposed different color images is formed on a surface of a rotating photoreceptor and then is transferred from the photoreceptor surface and then the aforesaid photoreceptor surface from which the toner image has been transferred is cleaned by a cleaning means in which one end portion of a blade is caused to be in contact with the photoreceptor surface and toners scraped off the photoreceptor surface onto the blade are caused to drop from the other end portion of the blade, and a single color mode in which a single color toner image is formed on a surface of a rotating photoreceptor and then is transferred therefrom and the photoreceptor surface is cleaned, after transferring, by aforesaid cleaning means, both modes being selectable, wherein, when the single color mode is selected and when the specified number of times for single color toner image formations is greater than the stipulated number, the control is made so that the cleaning means is switched, for each single color toner image formation in the specified number of formations, to its non-operation position in which one end portion of the blade of the cleaning means leaves the photoreceptor surface and the inclination of the blade is increased enough to cause toner staying on the blade to slide to the other end portion thereof.

Namely, in the third example of an image forming apparatus of the invention, when a single color mode is selected and the number of continuous formations for a single color toner image that is larger than the stipulated number, the blade of a cleaning means is switched to its non-operation position wherein its inclination is increased for each formation of a single color toner image in the stipulated number of formations, thereby, toners on the blade fall and retention of a large amount of toners on the blade is prevented.

DETAILED DESCRIPTION OF THE INVENTION

The first example of a color image forming apparatus of the invention is shown in FIGS. 1–10.

Figure 1:
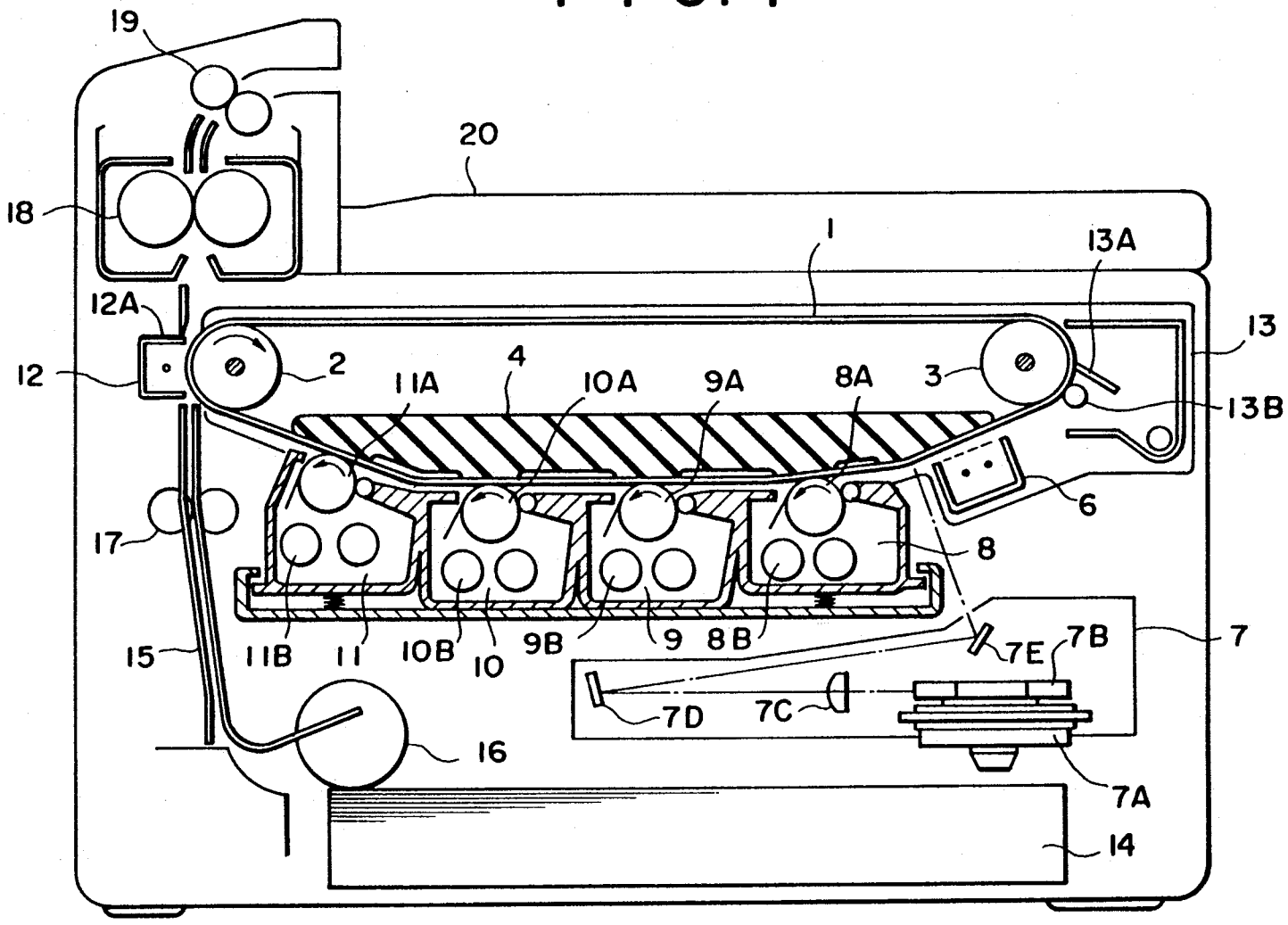
FIG. 1 is a sectional view of the structure of an image forming apparatus of the invention.

In FIG. 1, 1 represents a flexible photoreceptor belt that is a belt-like image retainer, and the photoreceptor belt 1 is spread between driving roller 2 and tension roller 3 and is moved clockwise by driving roller 2.

The numeral 4 is a guide member fixed on the main body of the apparatus so that it contacts the internal side of aforesaid photoreceptor belt 1, and aforesaid photoreceptor belt 1 is caused to rub, with its inside surface, the aforesaid guide member 4, being tensed by tension roller 3. Incidentally, guide member 4 is provided, at the portion thereof which is not used for image forming, with a recess that reduces resistance caused by friction. When resistance caused by friction is small, the recess does not naturally need to be provided. It is preferable, for the purpose of reducing the resistance caused by friction between photoreceptor belt 1 and guide member 4, to provide a low-friction member such as Teflon on the surface of either photoreceptor belt 1 or guide member 4, or to use aforesaid low-friction member to make them. Further, it is preferable to use a low-resistance member to make them for the purpose of preventing triboelectrification.

Therefore, the photoreceptor on the outer surface of aforesaid photoreceptor belt 1 is kept, (continuously) while it is running, to be constant in terms of position against the surface of aforesaid guide member 4, thus enabling the stabilized image forming surface to be assured.

It is further possible to prevent developer spewing and scattering by providing developing units and cleaning units below the photoreceptor belt.

The numeral 6 is a scorotron charger that is a charging means, 7 represents a unit of a laser-writing system, 8–11 represent developing units which are a plurality of developing means each containing developer of a specific color, and these developing means are arranged so that they face aforesaid guide member 4 for photoreceptor 1. These developing means are further arranged to be in contact, outside the photoreceptor belt 1, with aforesaid guide member 4 through a gap-keeping means for the purpose of maintaining the clearance to assure the movement of photoreceptor belt 1.

For aforesaid laser-writing system unit 7, an optical system wherein a light-emission portion for a LED or the like and a light-transmitter of a light-converging type are united solidly can also be used in addition to the optical system shown in the figure.

Aforesaid developing units 8, 9, 10 and 11 contain respectively a yellow developer, a magenta developer, a cyan developer and a black developer and are provided respectively with developing sleeves 8A, 9A, 10A and 11A each keeping a fixed clearance from photoreceptor belt 1 and developer mixing screw 8B, 9B, 10B and 11B, thus having a function for visualizing latent images on photoreceptor belt 1 through a non-contact developing method. The non-contact developing method has an advantage that it does not obstruct a movement of photoreceptor belt 1.

The numeral 12 is a transfer unit, 12A is a neutralizing plate, and 13 is a cleaning unit whose cleaning means such as blade 13A and toner-conveying roller 13B are kept away from the surface of photoreceptor belt 1 during a period of image-forming, and are caused to be in contact, with pressure, with the surface of photoreceptor belt 1 as shown in the figure only for the period of cleaning after image-transferring.

When color signals generated from an image-reading unit that is independent from aforesaid printer are inputted into aforesaid laser-writing system unit 7, a laser beam emitted from a semi-conductor laser (not shown) is subjected to rotation scanning through polygon mirror 7B rotated by driving motor 7A. And after passing through f$\theta$ and lens 7*c*, an optical path of the laser beam is deflected by mirror 7D and mirror 7E and projected onto the surface of photoreceptor belt 1 which is charged in advance by charging unit 6 that is a charging means, and forms a bright line.

When scanning is started, on the other hand, the beam is detected by an index sensor, modulation of the beam made by the first color signals in the direction of main scanning is started, and the modulated beam scans the surface of photoreceptor belt 1. Therefore, a latent image corresponding to the first color is formed on the surface of photoreceptor belt 1 through main scanning by means of the laser beam and sub-scanning by means of conveyance of photoreceptor belt 1. This latent image is subjected to reversal development made by developing unit 8 containing yellow (Y) toner (image-visualizing medium) out of developing units on condition of a non-contact basis, and thus a toner image is formed on the surface of the belt. The toner image thus obtained, while it remains on the surface of the belt, passes the lower side of aforesaid cleaning means that is kept away from the surface of photoreceptor belt 1, to enter the next copying cycle.

Namely, aforesaid photoreceptor belt 1 is charged again by aforesaid charging unit 6, and then the second color signals generated from a signal-processing portion are inputted into aforesaid writing system unit 7, thus, writing on a drum surface is conducted for forming a latent image in the same manner as in the occasion of the first color signals mentioned above. The latent image is developed by developing unit 9 containing magenta (M) toner as the second color on conditions of a non-contact basis and a reversal development basis.

This magenta (M) toner image is formed in the presence of aforesaid yellow (Y) toner image formed in the previous cycle.

The numeral 10 is a developing unit containing cyan (C) toner, and it forms a cyan (C) toner image on the drum surface based on controlling signals generated from the signal processing portion.

Further, 11 is a developing unit containing black toner, and it forms black toner images on the drum surface in the same way as in the foregoing so that the black toner image is superposed on the images formed in the previous cycles. D.C. or A.C. bias voltage is impressed on each sleeve of these developing units 8, 9, 10 and 11, and jumping development of an image-visualizing means by means of mono-component developer or two-component developer is conducted, thus development on a non-contact basis can be done on photoreceptor belt 1 whose base portion is electrically grounded.

A color toner image thus formed on the surface of photoreceptor belt 1 is transferred, at a transfer portion, onto an image-transfer material fed from paper-feeding cassette 14 through paper-feeding guide 15.

Namely, topmost one sheet of image-transfer materials loaded in paper-feeding cassette 14 is fed out by paper-feeding roller 16, and then supplied to transfer unit 12 through timing roller 17, synchronizing with image-forming on photoreceptor belt 1.

The image-transfer material subjected to image-transfer and neutralizing is surely separated, to go upward, from photoreceptor belt 1 that makes a sharp turn along aforesaid driving roller 2, without being affected, in terms of image quality, by scattered toner due to the effect of neutralizing, and is ejected onto tray 20 through paper-ejecting roller 19, after the image on the image-transfer material is fixed thereon by fixing roller 18. On the other hand, photoreceptor belt 1 an image on which has been transferred onto an image-transfer material continues being conveyed, and at the position of aforesaid cleaning unit 13 corresponding, in position, to tension roller 3 where blade 13A and rotating toner-conveying roller 13B are caused to be in pressure contact, toners staying on photoreceptor belt 1 is removed and after the completion thereof, aforesaid blade 13A is released and shortly after that, toner-conveying roller 13B is released, to enter the next image-forming process.

Figure 2:
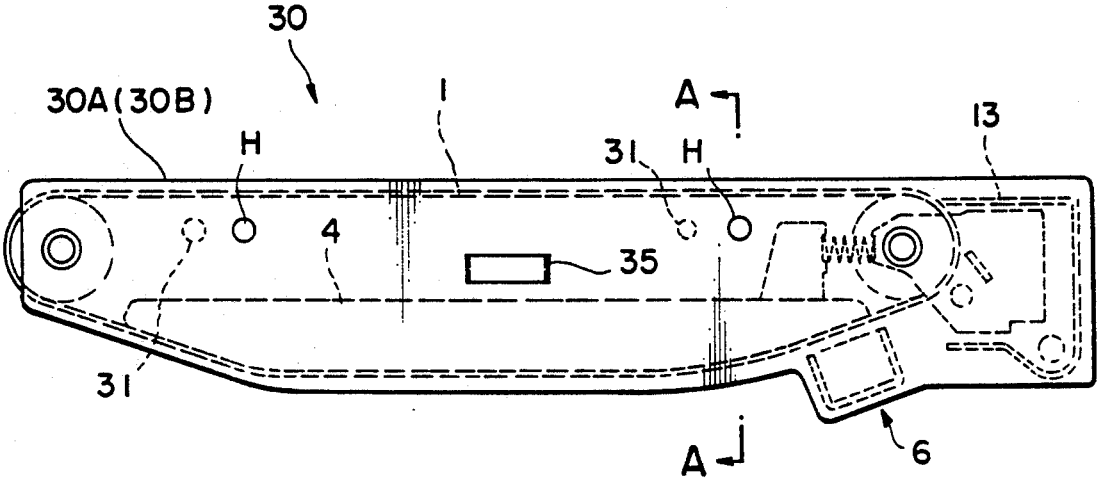
FIGS. 2 and 3 represent front views of a process cartridge and a developing unit to be incorporated in aforesaid apparatus respectively.

Image-forming means such as aforesaid photoreceptor belt 1, guide member 4, charging unit 6 and cleaning unit 13 are incorporated in process cartridge 30 composed of front base board 30A and rear base board 30B as shown in FIG. 2 and mounted on or dismounted from an apparatus main body.

Aforesaid cartridge 30 wherein front and rear base boards 30A and 30B are united solidly to hold aforesaid image-forming means therebetween through guide member 4 and two stays 31, is mounted on an apparatus main body through the horizontal insertion thereof from the front side of the main body.

Figure 3:
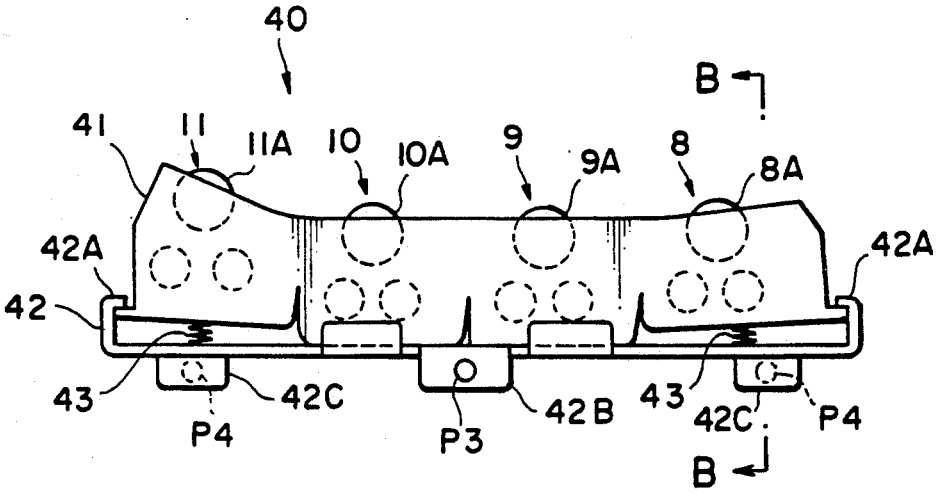

On the other hand, each developing unit mentioned above is incorporated in developing-unit-container 41 which is a single body and flexible as shown in FIG. 3 so that the developing unit is partitioned from others, and the developing-unit-container is positioned on supporting rest 42 to be mounted on or dismounted from the apparatus main body.

With regard to aforesaid developing-unit-container 41, a plurality of compression springs 43 are sandwiched in the longitudinal direction between bottom surfaces corresponding, in position, to developing units 8 and 11 and aforesaid supporting rest 42, and the developing-unit-container 41 is inserted almost horizontally from the front side of the apparatus main body to be mounted thereon, being held by hook members 42A on condition that a curvature of a curved surface touching developing sleeves is smaller than that of an image-forming surface of photoreceptor belt 1 formed by aforesaid guide member 4.

Figure 4:
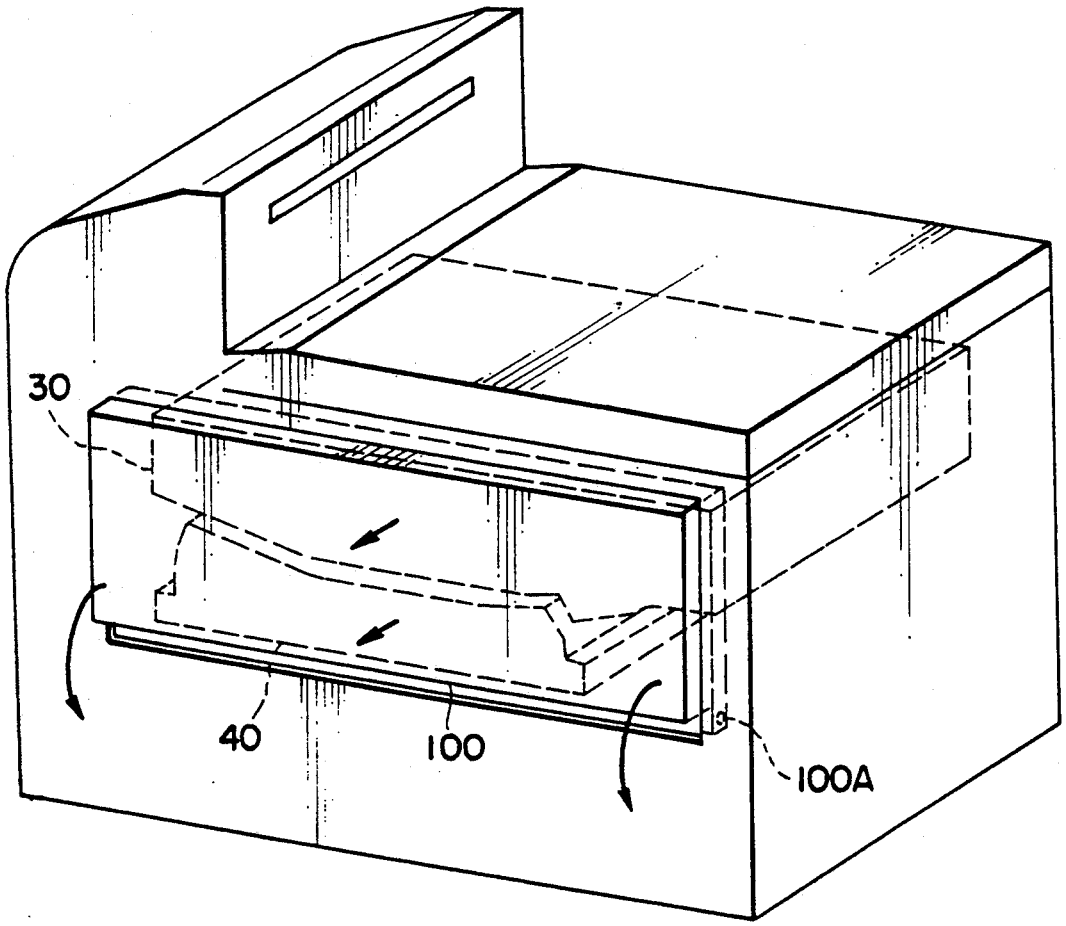
FIG. 4 is a perspective view of the front side of aforesaid apparatus.

It is possible to insert aforesaid cartridge 30 and developing unit 40 into the apparatus main body by opening front cover 100 of the apparatus main body shown in FIG. 4 toward an operator almost at a right angle with its supporting shaft 100A as a fulcrum.

Figure 5:
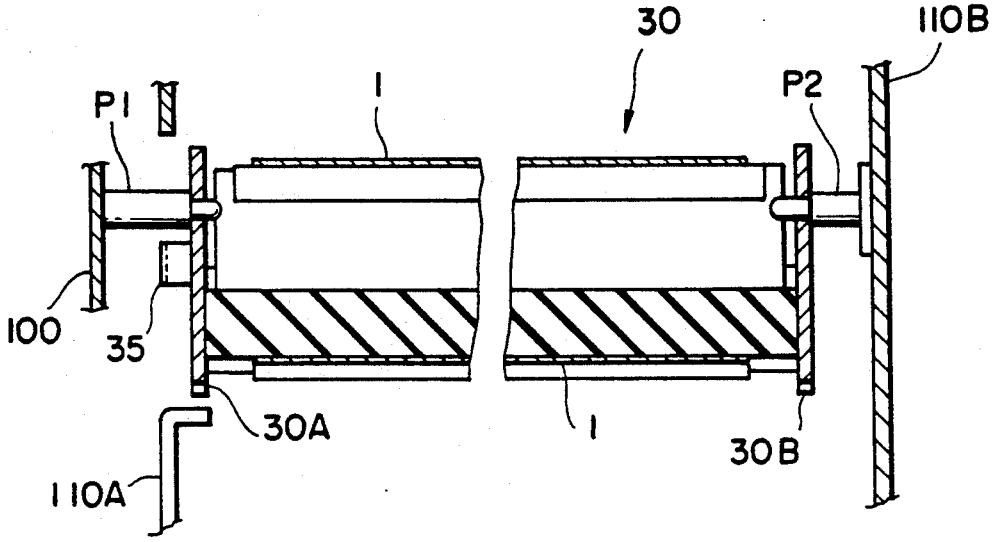
FIGS. 5 and 6 are sectional views of aforesaid cartridge and developing unit respectively.
Figure 6:
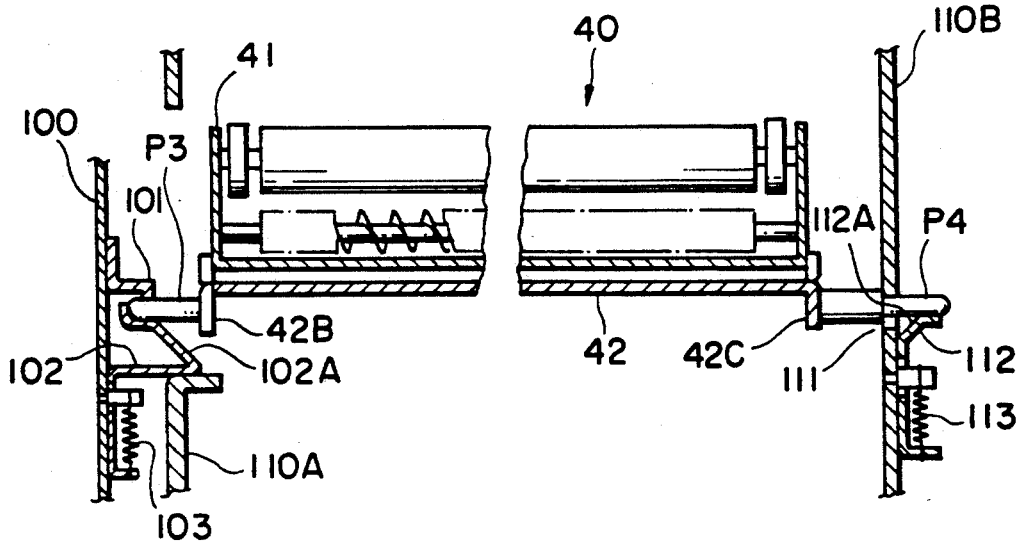

FIGS. 5 and 6 represent respectively a sectional view viewed along line AA of cartridge 30 shown in FIG. 2 and that viewed along line BB of developing unit 40 shown in FIG. 3.

Aforesaid cartridge 30 is provided with a pair of engaging holes H each facing with each other and passing through front and rear base boards 30A and 30B, and on the side of the apparatus main body, a pair of engaging pins P1 and P2 which engage with aforesaid engaging holes H are provided on internal sides of aforesaid front cover 100 and side panel 110B positioned at rear side of the main body.

For mounting aforesaid cartridge 30, engaging hole H on the side of base board 30B is first engaged with engaging pin P2 on aforesaid side panel 110B at the rear side to generate the condition that a part of base board 30A is supported by a bent portion of side panel 110A at front and then front cover 100 is closed, thereby cartridge 30 can be set to a prescribed position in the apparatus main body with aforesaid engaging pin P1 engaged with engaging hole H on the side of base board 30A.

With regard to aforesaid developing unit 40, on the other hand, engaging pin P3 is provided at bent portion 42B at the center of the front surface of aforesaid supporting rest 42 and engaging pin P4 is provided at a pair of bent portions 42C on the rear side, and on the side of the apparatus main body, there is provided an urging unit that moves developing unit 40 toward aforesaid cartridge 30 side, pressing aforesaid engaging pins P3 and P4.

In FIG. 6, 101 is a stop plate that regulates the upper limit of engaging pin P3 provided on the inside surface of aforesaid front cover 100 for developing unit 40, and 102 is a pressure plate provided with slanted surface 102A and guided to slide upward by means of tension spring 103, and when developing unit 40 is not mounted, the pressure plate 102 is kept slightly higher than the position shown in the figure.

On the other hand, 111 is an elongated hole on side panel 110B on the rear side provided for the purpose of engaging with aforesaid engaging pin P4, 112 is a pressure plate provided with slanted surface 112A and guided by tension spring 113 to slide upward, and when developing unit 40 is not mounted, the pressure plate 102 is kept slightly higher than the position shown in the figure.

For mounting aforesaid developing unit 40, engaging pin P4 on the rear surface is first inserted into elongated hole 111 on aforesaid side panel 110B on the rear side, and then bent portion 42A at the center on the front side is put on the top of side panel 110A on the front side. When aforesaid engaging pin P4 is inserted into elongated hole 111, slanted surface 112A is pushed to cause pressure plate 112 to slide downward. However, after the engagement of engaging pin P4 and the elongated hole, the pin is urged by the restoring force of pressure plate 112 against the upper end of aforesaid elongated hole 111.

Therefore, aforesaid developing unit 40 is maintained slanted in its posture with its front side being lowered, keeping developing sleeves 8A–11A away from photoreceptor belt 1 incorporated in aforesaid cartridge 30, resulting in that aforesaid cartridge 30 can be mounted on or dismounted from the apparatus main body without interfering with developing unit 40 at all.

Aforesaid developing unit 40 is set in the prescribed position automatically when aforesaid front cover 100 is closed, similarly to cartridge 30, and thereby each developing sleeve is positioned to form a predetermined developing clearance with photoreceptor belt 1.

Namely, in the process of opening front cover 100, aforesaid pressure plate 102 pushes up, with its slanted surface 102A, engaging pin P3 on developing unit 40 supported by side panel 110A on the front side, and after the front cover is closed, aforesaid engaging pin P3 is held between pressure plate 102 and stop plate 101.

As a result of the foregoing, aforesaid developing unit 40 is kept horizontally and urged with pressure against cartridge 30. Therefore, a contact roller of each developing unit is caused to be in pressure contact with aforesaid guide member 4 and thus the clearance between each developing sleeve and photoreceptor belt 1 is determined. Incidentally, when developing unit 40 is kept in pressure contact, a contact roller of each developing sleeve is caused to be in pressure contact with a curved surface of guide member 4 with a constant load due to flexibility of developing- unit-container 41 itself and elasticity of aforesaid compression spring 43 acting on the developing-unit-container 41.

Figure 7:
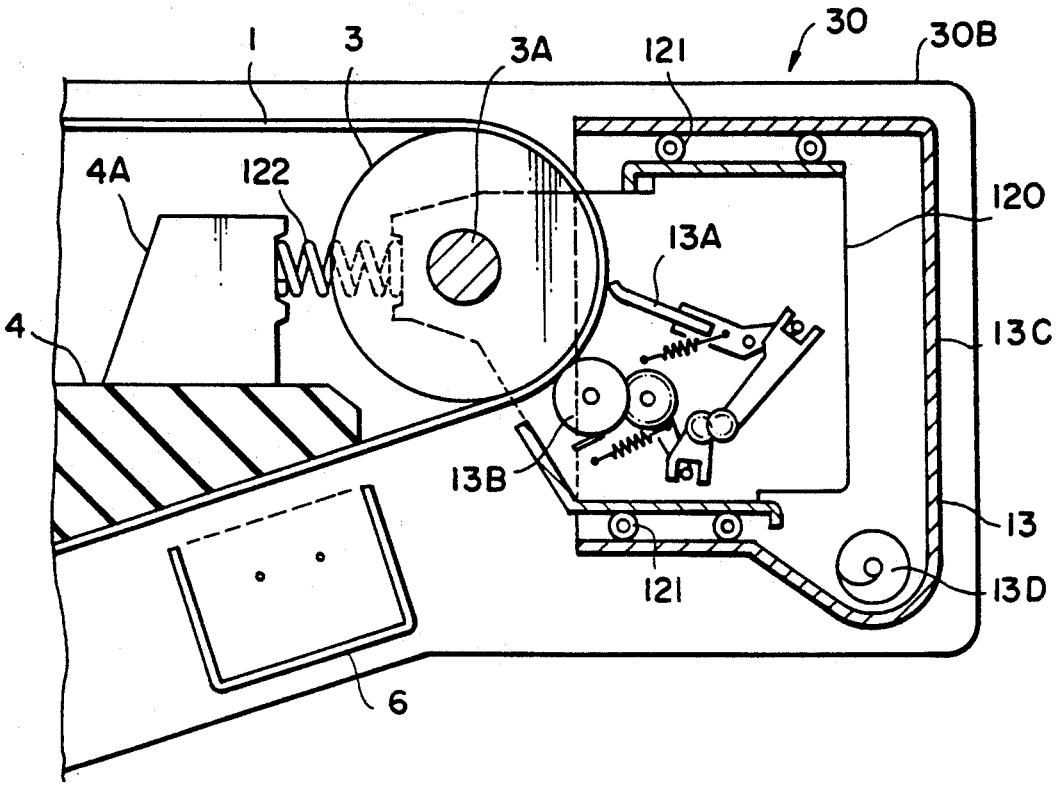
FIGS. 7 and 8 represent sectional views of the primary portions of the first example of aforesaid cartridge.

FIG. 7 shows the first example of the invention related to how tension roller 3, cleaning means that is blade 13A and roller 13B are arranged on aforesaid cartridge 30 and their supporting mechanisms.

Aforesaid tension roller 3 and each cleaning means are attached to movable frame body 120 that is separated from casing 13C of cleaning unit 13 and supported thereon, and after being positioned against photoreceptor belt 1 by using the movable frame body 120 as a relational-position-keeping member, they are incorporated in aforesaid cleaning unit 13.

Aforesaid movable frame 120 is contained and supported in casing 13C in the state that the movable frame 120 can slide horizontally and freely, being guided by two pairs of guide rollers 121 each provided at the upper position and the lower position both in front and in rear on the internal side.

Positioning of aforesaid movable frame 120 in casing 13C, namely, setting of tension of aforesaid photoreceptor belt 1 is made by urging force of compression spring 122 sandwiched between the left end surface of movable frame 120 and protrusion 4A positioned at the upper portion of guide member 4. Due to the urging force of compression spring 122, movable frame 120 slides toward the right in the figure to cause photoreceptor belt 1 to become tense, and thereby the tension of photoreceptor belt 1 is determined. In order for movable frame 120 to be urged at both ends in front and in rear, the number of aforesaid compression spring 122 is two, and thereby the movable frame 120 is urged by the compression springs in a well-balanced state, thus photoreceptor belt 1 can be uniformly tense over its entire width.

Figure 8:
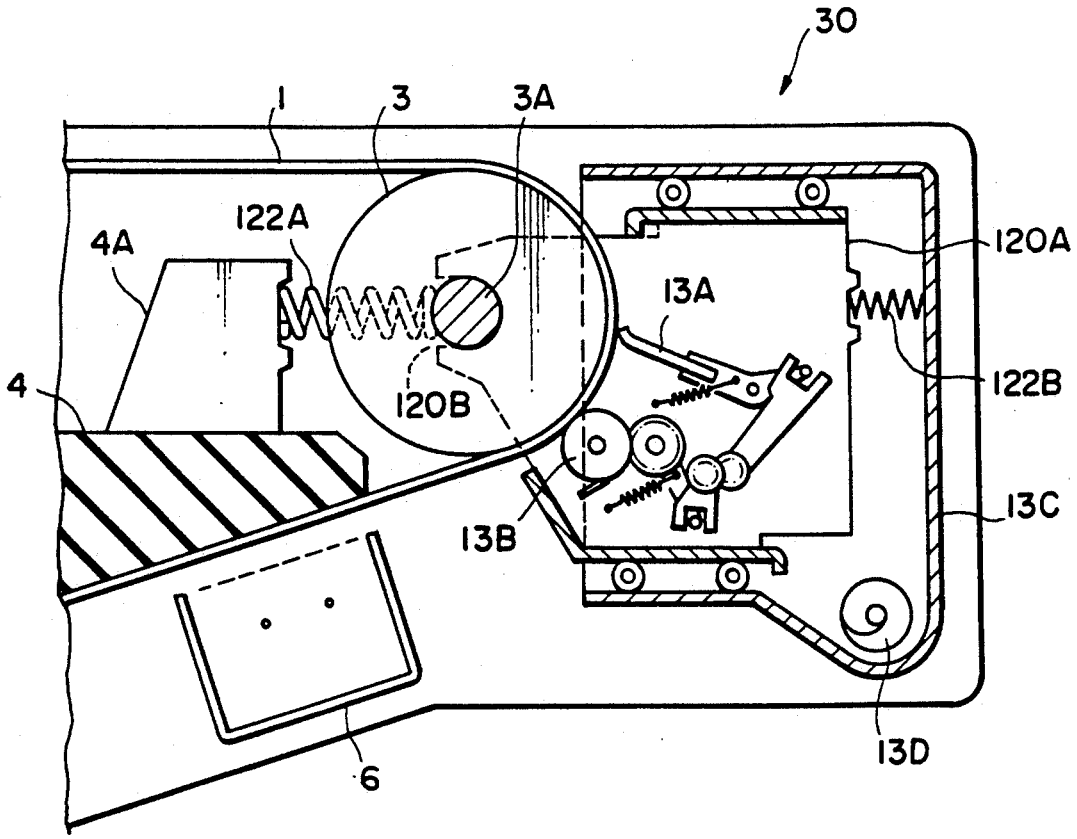

FIG. 8 shows the first example of other application of the invention wherein movable frame 120A supports cleaning means only, namely blade 13A and roller 13B only, and receives, with engaging portion 120B in a recessed shape formed at its left end surface, the supporting shaft 3A of tension roller 3 that is urged directly toward the right by compression spring 122A.

Namely, aforesaid movable frame 120A is urged toward the left by compression spring 122B sandwiched between casing 13C and movable frame 120A, and balance between the compression spring 122B and aforesaid compression spring 122A regulates the position of movable frame 120A, and such condition gives an optimum tension to photoreceptor belt 1.

Incidentally, it is preferable for the stabilized position of movable frame 120A that the optimum tension of photoreceptor belt 1 is obtained under the condition in which the urging force of compression spring 122B is one-fifth and less than that of compressing spring 122A.

Further, it is possible to form movable frame 120 wherein both movable frame 120 and casing 13C are united solidly, though they are separated in FIGS. 7 and 8.

Figure 10:
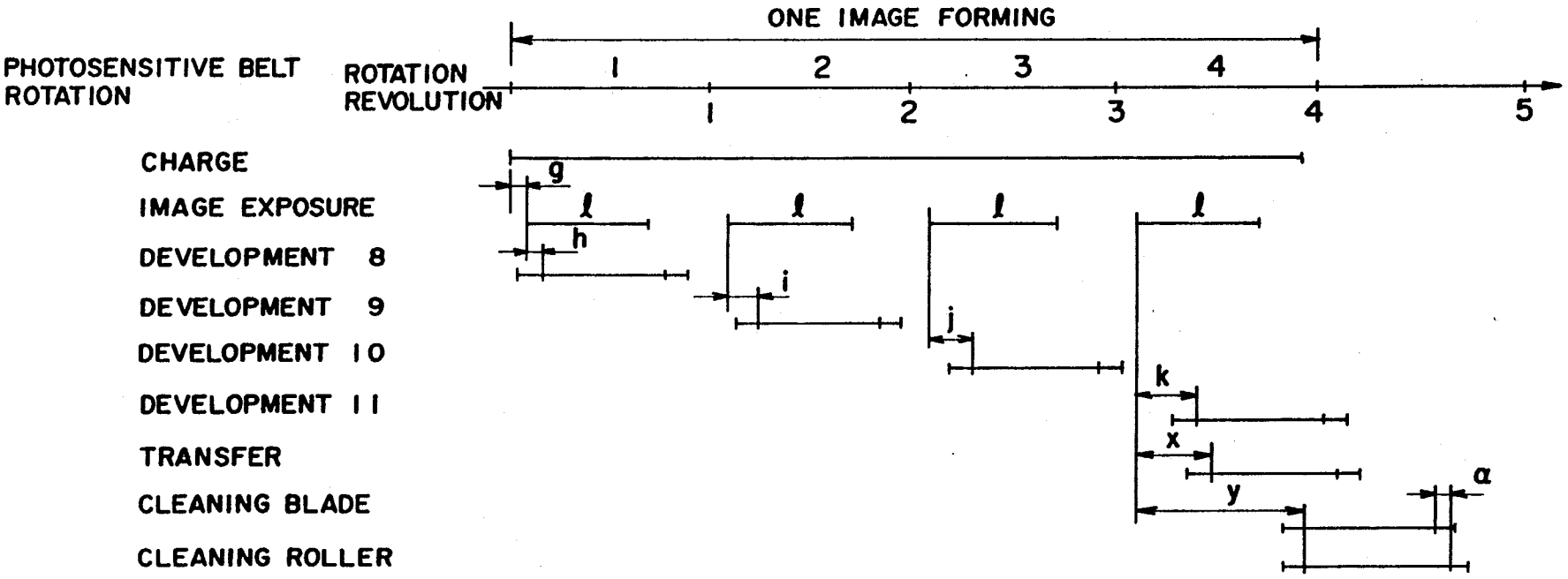
FIG. 10 is a time chart showing the sequence of image forming.

The sequence of color image forming by means of aforesaid cartridge 30 and developing unit 40 will be explained as follows, referring to FIG. 10.

Photoreceptor belt 1 that starts moving with a rotation of driving roller 2 starts being charged by charging unit 6 simultaneously with the movement of the photoreceptor belt 1. In the first rotation of photoreceptor belt 1, the imagewise exposure by aforesaid first color signals is started after time g from aforesaid charging, then the photoreceptor belt 1 is subjected to development processing by means of developing unit 8 after time h from aforesaid start of the imagewise exposure. After that, photoreceptor belt 1 advances to its second rotation and it is subjected to the imagewise exposure by aforesaid second color signals and to the development processing by means of developing unit 9 that is started after time i from the start of aforesaid imagewise exposure. Further, in the third rotation, the photoreceptor belt 1 is subjected to the imagewise exposure by aforesaid third color signals and to the development processing by means of developing unit 10 that is started after time j from the start of aforesaid imagewise exposure. Further, in the fourth rotation, the photoreceptor belt 1 is subjected to the imagewise exposure by black signals and to the development processing by means of developing unit 11 that is started after time k from the start of aforesaid imagewise exposure, thus a color image is obtained.

In this case, time h, i, j and k represent a period of time required for photoreceptor belt 1 to arrive at the position of each development processing from the position of imagewise exposure, and similarly, x is a period of time required to arrive at transfer unit 12 from the position of imagewise exposure, and y is a period of time required to arrive at the pressure-contact point for blade 13A of cleaning unit 13 from the position of imagewise exposure. Further, 1 represents a period of time required for the entire page of an original to pass through a fixed point in imagewise exposure or development processing and others, and actual time required for development processing, transferring or cleaning or the like is shown by aforesaid line 1 plus dotted lines added to the both ends of the line 1 as a margin.

A color toner image thus formed is transferred onto an image-transfer paper in and after the second half of the fourth rotation of photoreceptor belt 1, and the image-transfer paper is ejected onto paper-ejection tray 20 as stated above through fixing roller 18 and paper-ejection roller 19, while, residual toner still staying on photoreceptor belt 1 are removed by blade 13A and roller 13B of cleaning unit 13 so that the photoreceptor belt 1 may be prepared for charging for the next cycle of image-forming. In this case, l represents a delay time after which from the detachment of blade 13A of cleaning unit 13 from photoreceptor belt 1, the roller 13B is detached from photoreceptor belt 1, and it is a margin to be added to a period of time required for the fixed point on the photoreceptor belt 1 to arrive at the pressure-contact point between photoreceptor belt 1 and blade 13A from the pressure-contact point between photoreceptor belt 1 and roller 13B.

Figure 9A:
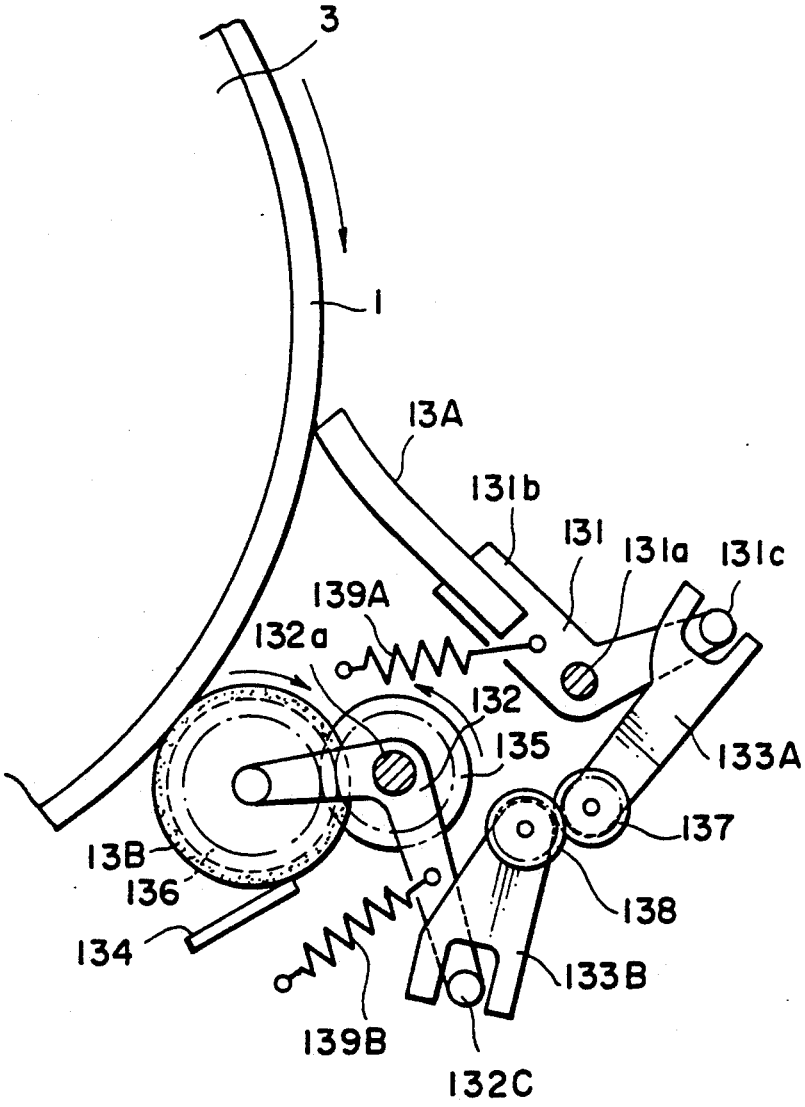
FIG. 9*a* and 9*b* is an illustration showing a function of each cleaning means.
Figure 9B:
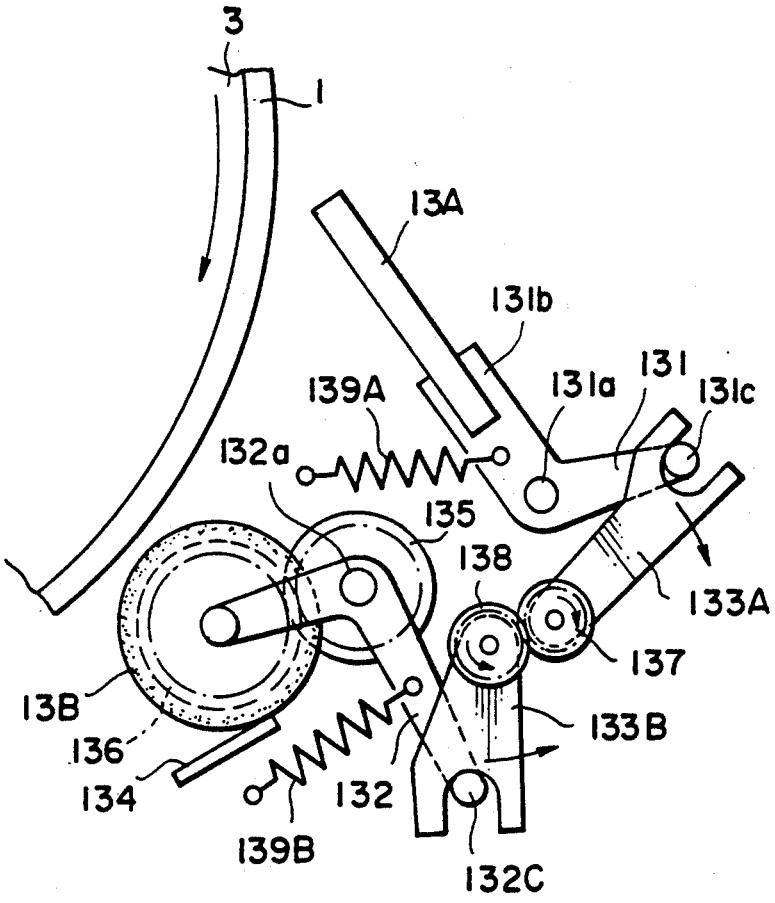

Next, aforesaid cleaning unit 13 will be explained in detail, referring to FIGS. 9(*a*) and 9(*b*). FIG. 9 (*a*) shows the state wherein each cleaning means is kept in pressurecontact with photoreceptor belt 1 and FIG. 9 (*b*) shows the state wherein each cleaning means is released from its pressure-contact.

In the figure, 131 is a swiveling lever in a doglegged shape provided rotatably around shaft 131*a* and its one end that is a blade holder 131*b* holds cleaning blade 13A and the other end is provided with pin 131*c*. The numeral 132 is a swiveling lever in a doglegged shape provided rotatably around shaft 132*a* and cleaning roller 13B is provided rotatably on its one end and pin 132*c* is studded on the other end. Both 133A and 133B are levers fixed respectively on gear 137 and gear 138 both are engaged with each other and tips of levers are formed to be in a shape of a fork to engage respectively with pin 131*c* and pin 132*c*. The numeral 134 is a scraping plate made of hard urethane rubber in a shape of a plate, and each of 139A and 139B is a tension spring and tension springs 139A and 139B are spread respectively between casing 13*c* and swiveling lever 131 and between casing 13*c* and swiveling lever 132 so that tension spring 139A urges swiveling lever 131 to rotate counterclockwise and tension spring 139B urges swiveling lever 132 to rotate clockwise. Cleaning blade 13A (blade 13A) is a blade made of a hard urethane rubber plate having a length equivalent to the total width of photoreceptor belt 1, and it is positioned so that its tip is directed toward the upstream side of the movement of photoreceptor belt 1. Cleaning roller 13B (roller 13B) is a roller that is positioned at the downstream side of aforesaid blade 13A and its outside portion is made of sponge-like foamed plastics, and it is rotated through the engagement of gear 136 provided coaxially with roller 13B and gear 135 fixed on shaft 132*a* in the direction opposite to that of tension roller 3 during cleaning.

A driving mechanism for aforesaid cleaning means is mounted on the outer side in front and in rear of movable frame 120 or 120A shown in FIG. 7 or FIG. 8, shaft 131*a* and shaft 132*a* pass through casing 13C, a pair of gears 135 and 137 in front and in rear are operated by the control of the control unit in the apparatus main body, and gear 135 is driven by the driving source in the apparatus main body.

During a period of cleaning, gears 137 and 138 are free as shown in FIG. 9 (*a*) and blade 13A is kept, by tension spring 139A, in contact under predetermined pressure with the surface of photoreceptor belt 1, and thereby residual toners are scraped for cleaning and drop on the bottom of casing 13C.

Further, roller 13B is kept, by tension spring 139B, to be in contact under predetermined pressure with the surface of photoreceptor belt 1 to wipe off residual toner, and wiped toner is scraped by scraping plate 134 and drop on the bottom of casing 13C.

After photoreceptor belt 1 has been cleaned up, gear 137 is rotated clockwise by the control of a controlling unit and gear 138 engaging with gear 137 is rotated counterclockwise, and lever 133A fixed to gear 137 is rotated clockwise and lever 133B fixed to gear 138 is rotated counterclockwise. Therefore, swiveling lever 131 is rotated clockwise and swiveling lever 132 is rotated counterclockwise, and blade 13A and roller 13B are released from their pressure-contact shown in FIG. 9 (*b*).

In this case, an adjustment is made so that roller 13B is released from its pressure-contact time $\alpha$ behind the releasing of blade 13A from its pressure-contact due to the gear ratio of gears 137 and 138, ratio of length between lever 133A and 133B, and clearance between fork portions and pins 131C and 132C.

Therefore, even if toner lumps are generated and stay on photoreceptor belt 1 when blade 13A is in pressure-contact with or released from photoreceptor belt 1, the toner lumps are completely removed by roller 13B and the photoreceptor belt is cleaned.

Incidentally, toners removed from photoreceptor belt 1 can be transported to be collected into a toner collection container attached solidly to aforesaid guide member 4, for example, by toner-transport-screw 13D running in casing 13C. Since casing 13C itself is positioned at a fixed location constantly, it is possible to provide a screw and a pipe for toner-transport easily, similarly to other general image-forming apparatuses.

Further, when a mechanism enabling aforesaid compression spring 122 or 122A to be released from its urging force against supporting shaft 3A is provided, it is possible to cause photoreceptor belt 1 to be free from tension in non-operation period of the apparatus, thereby the photoreceptor belt 1 can be free from its curled permanent set and its durability is improved.

Figure 11:
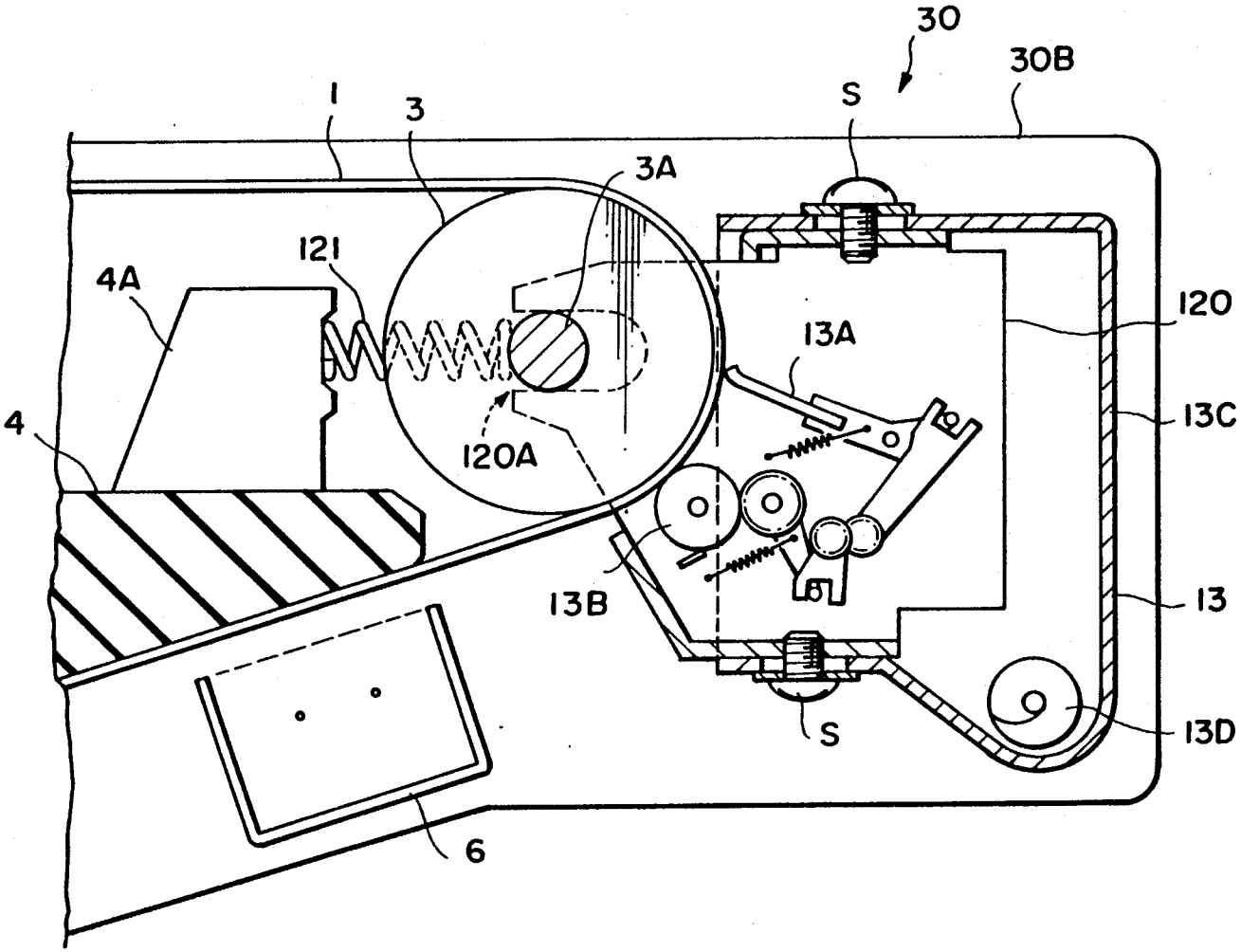
FIG. 11 is a sectional view of primary portions of the second example of aforesaid cartridge.

FIG. 11 shows the second example of the invention relating to the structure for attaching and supporting tension roller 3 and cleaning means of blade 13A as well as roller 13B on aforesaid cartridge 30.

Cleaning unit 13 is composed of casing 13C fixed on cartridge 30 and of movable frame 120 that is inscribed in the casing 13C and is capable of sliding from side to side, and aforesaid casing 13C is provided with toner-transport-screw 13D for toner collection on its bottom and blade 13A as well as roller 13B, on the other hand, are supported on aforesaid movable frame 120 through each operating member which will be mentioned later.

Aforesaid movable frame 120 can be fixed at any position in the lateral direction by a plurality of set screws S passing through elongated holes provided on both upper and bottom panels of casing 13C within an adjustment range of the elongated holes.

Further, aforesaid movable frame 120 is provided, on its left end portion, with engaging portion 120A in a cutout shape which engages with supporting shaft 3A of aforesaid tension roller 3 that is urged toward the right side by compression spring 121 sandwiched by protrusion 4A positioned at the upper portion of guide member 4, thus the movable frame is regulated so that it moves only in the horizontal direction.

Therefore, when aforesaid movable frame 120 is fixed with set screws S so that tension of photoreceptor belt 1 wound around tension roller 3 by the urging force exerted by aforesaid compressing spring 121 and pressure exerted by cleaning means are on their optimum condition, engaging portion 120A of the movable frame 120 can serve as a regulating member that regulates the position of the shaft of tension roller 3 and can function to keep each cleaning means at the constant setting position against photoreceptor belt 1.

Usually, tension of a tension roller caused by a compression spring is much greater than pressure caused by cleaning. Therefore, it is preferable that a cleaning portion is fixed while increasing pressure that is necessary for cleaning, after causing photoreceptor belt 1 to be in a state of tension.

With regard to aforesaid compression spring 122, a pair of them are provided so that they function against two surfaces in front and in the rear of movable frame 120, thereby urging the movable frame 120 on well-balanced condition to cause photoreceptor belt 1 to be tensed uniformly over its entire width.

Incidentally, with regard to a process cartridge, it is possible to make one containing even a group of developing units united solidly thereto.

Figure 12:
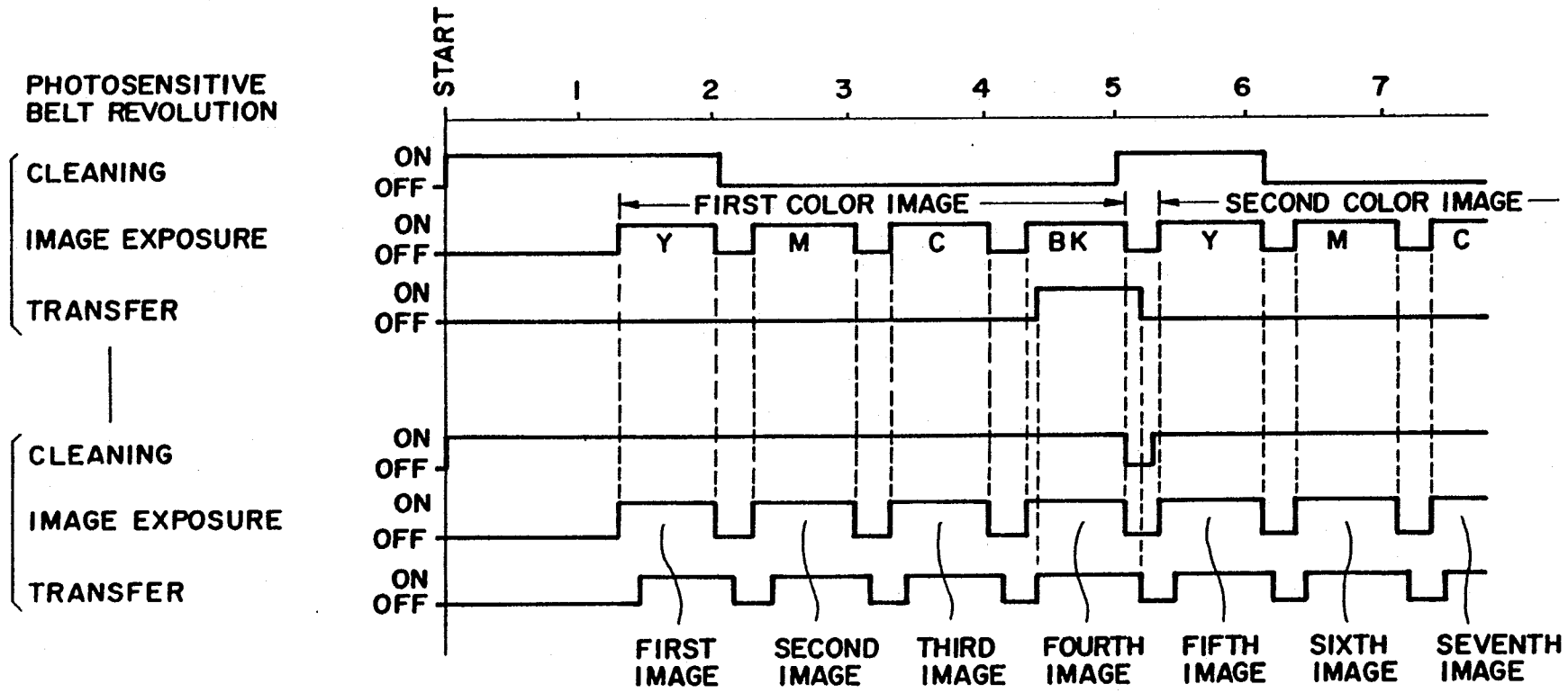
FIG. 12 is a time chart showing the sequence of image forming in the third example.

Further, in aforesaid first and second examples, toner images are superposed on an image-forming member and then they are transferred. However, the invention is not limited only to this, and it can also be embodied, with the same effect, in one wherein a toner image is transferred onto an image-transfer means each time the image is formed on an image-forming member, for forming a color image. FIG. 12 shows a time chart showing main operations in a color mode and a single color mode in the third example of the invention. In the example of FIG. 12, an image-forming surface for a 3-color-toner image is also charged uniformly by charging unit 6 in the same way as in the previous case, and the surface charged uniformly is subjected to inputting of imagewise exposure for a black (BK) image conducted by laser-writing unit 7. An electrostatic image thus formed is developed as a BK toner image by developing unit 11 employing BK toner as a developer, Thus, 4 color toner images each having its own color such as Y, M, C or K and being superposed each other are formed on the surface of photoreceptor belt 1. These color toner images are transferred, by transfer unit 12, onto an image-transfer paper that is fed out from, paper-feed cassette 14 and conveyed by roller 16 and timing roller 17 through paper-feeding guide 15 so that it adjoins photoreceptor belt 1, and then the image-transfer paper with color toner images thereon being fixed thereon by heat-fixing roller 18 is ejected onto paper-ejection tray 20 by paper-ejection roller 19.

On the other hand, the surface of photoreceptor belt 1 from which color toner images have been transferred is cleaned by cleaning unit 13 that is turned on again, and when the specified number of formations of color toner images is one, photoreceptor belt 1 is caused to stop and cleaning unit 13 is turned off after photoreceptor belt 1 makes not less than one turn, thus an image forming process is completed. When the specified number of formations is plural as shown in FIG. 1, image-forming processes each, including a charging step by means of charging unit 6 and other steps similarly to the previous case are repeated on the surface of aforesaid photoreceptor belt 1 cleaned by cleaning unit 13. Thereby, after color toner image formations in the specified number are completed, a series of image-forming processes are finished finally similarly to the occasion wherein the specified number of image-formations is one.

In the color toner image forming process mentioned above, blade 6A is switched, immediately after cleaning the surface of photoreceptor belt 1 from which color toner images have been transferred, to the non-operation position shown in FIG. 9(*b*) to be sharply slanted, and thereby toners staying on blade 13A fall on the portion where toner-transport-screw 13D is provided, resulting in stable cleaning without having a large amount of toners staying on blade 13A.

A single color toner image is formed in the following process in the present image forming apparatus. Namely, when an image forming process is started as shown in FIG. 12 after selecting a single color mode of BK color, for example, and specifying the number of formations for a single color toner image, a uniformly charged surface of photoreceptor belt 1 is subjected to inputting of imagewise exposure for a black and white image conducted by laser-writing unit 7, thus an electrostatic image is formed, and the process thereafter is conducted in the same manner as in a color mode up to the step where the electrostatic image is developed to be a BK toner image by developing unit 11 employing BK toners as a developer. Next, in a single color mode, a BK toner image formed is transferred onto an image-transfer paper that is fed out from paper-feed cassette 14 and conveyed to the position of transfer unit 12, and then the image-transfer paper with a BK toner image being fixed thereon is ejected onto paper-ejecting portion 20. The surface of photoreceptor belt 1 from which a BK toner image has been transferred is cleaned by cleaning means 13 that is in the state of ON, and when the specified number of formations of single color images is one, photoreceptor belt 1 is caused to stop and cleaning unit 13 is turned off after photoreceptor belt 1 makes not less than one turn, and thus an image-forming process is completed. When the specified number of image formations is plural, image-forming processes each including a charging step by means of charging unit 6 and other steps similarly to the previous case are repeated on the surface of aforesaid photoreceptor belt 1 cleaned by cleaning unit 13. Thereby, after single color toner image formations in the specified number are completed, a series of image-forming processes are finished finally similarly to the occasion wherein the specified number of image-formations is one. However, cleaning unit 13 is not kept to be ON during the image forming period depending on the specified number of image formations. When the specified number of image formations is 5 or more in an example shown in FIG. 12, blade 13A is switched once to the position shown in FIG. 9(*b*) during a period from the time when the surface on which the fourth single color toner image is formed finishes passing the cleaning position to the time when the surface on which the fifth single color toner image is formed starts passing the cleaning position. In the aforesaid manner, blade 6A is switched once to the position shown in FIG. 9(*b*) while the transfer of a single color toner image is repeated four times. Thereby, it is avoided that toner in the amount equivalent to or more of residual toner accumulated on blade 13A after 4 image transfers stay on blade 13A, resulting in stable cleaning even in the case of a single color mode.

When a continuous single color toner image formations for less than 4 times is repeated with an interval, toners on blade 13A fall spontaneously from the blade 6A in the pause duration, resulting in no problem. Further, if blade 13A is arranged so that it can be switched manually to the position shown in FIG. 9(*b*), it can cope with troubles.

In addition to the examples mentioned above, the third example of the invention can be applied to an image forming apparatus wherein 3-color toner images or 2-color toner images are transferred and further to an image forming apparatus wherein a drumlike photoreceptor is used. Further, in a single color mode, the number of image formations during which a blade is switched to non-operation condition is not naturally limited to only four. In an image forming apparatus shown in the figure, an apparatus frame portion on the left side of a path for an image-transfer paper can be separated from the one on the right side thereof for easy clearance of jamming of an image-transfer paper.

Owing to the invention, an image retainer in a belt shape can be spread to run with constant tension without needing tension member in particular, and each cleaning means can be kept at its optimum position against the belt surface, thus an image forming apparatus capable of offering constantly the color images with stable and high image quality due to the proper running of the image-carrier and efficient cleaning therefor.

Further, a photoreceptor can be cleaned by a blade stably not only in an image forming process of a color mode but also in an image forming process of a single color mode.

What is claimed is:

1. A color image forming apparatus, for producing an image of an original, including a main body, and at least one cartridge or developing unit which is detachable from said main body, said developing unit comprising means for developing latent images with toner, said cartridge comprising;

a belt-like image retainer for holding a latent image of said original image;

means for supporting said belt-like image retainer, said supporting means including a means for driving said belt-like image retainer and a means for cooperatively supporting said belt-like image retainer with said driving means;

means for developing said latent image with toner;

means for providing additional support for said belt-like image retainer so that a surface of said belt-like image retainer contacts said developing means, said additional supporting providing means having a surface contacting said belt-like image retainer;

means, located near said cooperative supporting means, for cleaning residual toner from said belt-like image retainer;

spring means, associated with said cooperative supporting means, for maintaining a predetermined mechanical tension in said belt-like image retainer, and for urging said belt-like image retainer onto said cleaning means;

means for urging said cleaning means onto said image retainer; and means for maintaining the predetermined mechanical relation between said belt-like image retainer supporting means and said cleaning means regardless of tension of said image retainer as set by said spring means.

2. The apparatus of claim 1, wherein said driving means and said cooperatively supporting means are adapted to provide an increased tension on said belt-like image retainer on an upstream side of said driving means compared to a downstream side of said driving means; and said developing means comprises a plurality of developing means each of which respectively contains a different color toner, and wherein said developing means is located at said upstream side of said driving means.

3. The apparatus of claim 2, further comprising:

means for selecting one of a multi-color mode and a mono-color mode, wherein when the apparatus is in said multi-color mode, said image having multiple color toner layers is formed on said image retainer, and when the apparatus is in said mono-color mode, said image having a single color toner layer is formed on said image retainer; and means for separating the cleaning means from said image retainer once every predetermined number of image forming processes when said mono-color mode is selected.

4. The apparatus of claim 1, further comprising:

means for movably holding said cleaning means wherein said holding means is fixed to a casing for partly enclosing said cleaning means.

5. A color image forming apparatus, for producing an image of an original, including a main body, and at least one cartridge or developing unit which is detachable from said main body, said developing unit comprising means for developing latent images with toner, said cartridge comprising;

a belt-like image retainer for holding a latent image of said original image;

means for supporting said belt-like image retainer, said supporting means including a means for driving said belt-like image retainer and a means, including an axis and a surface of revolution about said axis, for cooperatively supporting said belt-like image retainer with said driving means;

means for developing said latent image with toner;

means for providing additional support for said belt-like image retainer so that a surface of said belt-like image retainer contacts said developing means, said additional support providing means having a surface contacting said belt-like image retainer;

means, located near said cooperatively supporting means, for cleaning residual toner from said belt-like image retainer;

spring means, associated with said cooperative supporting means, for maintaining a predetermined mechanical tension in said belt-like image retainer; and means for maintaining the predetermined mechanical relation between said belt-like image retainer supporting means and said cleaning means regardless of tension of said image retainer as set by said spring means, wherein said maintaining means is pivotally suspended on said axis of said cooperatively supporting means;

wherein said spring means is connected to said cooperatively supporting means of said belt-like image retainer so that said spring means moves said cooperatively supporting means and said cleaning means simultaneously.

6. The apparatus of claim 5, wherein said driving means and said cooperatively supporting means are adapted to provide an increased tension on said belt-like image retainer on an upstream side of said driving means compared to a downstream side of said driving means; and said developing means comprises a plurality of developing means each of which respectively contains a different color toner, and said developing means is located at said upstream side of said driving means.

7. The apparatus of claim 6, further comprising:

means for selecting one of a multi-color mode and a mono-color mode, wherein when the apparatus is in said multi-color mode, said image having multiple color toner layers is formed on said image retainer, and when the apparatus is in said mono-color mode, said image having a single color toner layer is formed on said image retainer; and means for separating the cleaning means from said image retainer once every predetermined number of image forming processes when said mono-color mode is selected.

8. The apparatus of claim 5, further comprising:

means for movably holding said cleaning means wherein said holding means is fixed to a casing for partly enclosing said cleaning means.

* * * * *